United States Patent [19]

Pelcin

[11] 4,138,869

[45] Feb. 13, 1979

[54] SELF-LOCKING KEY-CONTROLLED DOOR LOCK

[75] Inventor: Albert L. Pelcin, Aurora, Ohio

[73] Assignee: The Eastern Company, Cleveland, Ohio

[21] Appl. No.: 836,784

[22] Filed: Sep. 26, 1977

[51] Int. Cl.[2] ..... E05B 55/02

[52] U.S. Cl. ..... 70/151 R; 70/210; 70/DIG. 36; 292/173; 292/DIG. 31

[58] Field of Search ..... 70/151 R, 150, 153, 70/489, 208–210, 215, DIG. 27, DIG. 31, DIG. 36; 292/173, DIG. 31

[56] References Cited

U.S. PATENT DOCUMENTS

| | | | |
|---|---|---|---|
| 1,035,073 | 8/1912 | Augenbraun | 70/150 |
| 2,916,905 | 12/1959 | Podlesak | 70/150 |
| 3,209,564 | 10/1965 | Pelcin | 70/208 X |
| 3,668,907 | 6/1972 | Pastua, Jr. | 70/153 |

OTHER PUBLICATIONS

Eberhard Manufacturing Co., Drawings No. 4910, No. 4910–20, and No. 4910–21.

*Primary Examiner*—Roy D. Frazier
*Assistant Examiner*—William E. Lyddane
*Attorney, Agent, or Firm*—David A. Burge, Co.

[57] ABSTRACT

A flush-mountable, key-controlled, handle-operated door lock is provided with an automatic self-locking linkage for permitting the handle to move once, but only once, out of a nested position after a key control has been operated to "cock" the linkage. Once the linkage has been cocked, the handle can be moved one time out of and returned to its nested position, whereafter the linkage operates to retain the handle in its nested position until the key control is again operated to cock the linkage. The automatic latching linkage includes a housing assembly, a pair of cams, and a pair of springs. A feature of the automatic latching linkage is that its several components can be assembled easily on an existing, in-service lock to provide the existing lock with a one-trip automatic locking capability. The latching linkage components are assembled by installing the components one at a time in an essentially stacked arrangement, one atop the other. The simple assembly steps required can be carried out even where accessibility to the rearward face of an in-service lock is quite limited.

16 Claims, 13 Drawing Figures

SELF-LOCKING KEY-CONTROLLED DOOR LOCK

BACKGROUND OF THE INVENTION

1. Field of the Invention

The present invention relates generally to a flush-mountable slam-type lock having a spring projected sliding bolt, a handle for retracting the bolt, and a key control for selectively permitting and preventing the handle to move out of a nested position. More particularly, the invention relates to locks of this sort including an automatic one-trip latching linkage of the type which requires that a key control be operated prior to but not necessarily concomitantly with each movement of the handle out of its unlocked position.

While the present invention has particularly advantageous use in conjunction with flush-type door locks used on swinging doors of trucks, industrial cabinets and the like, principles of the invention are not limited in application to such uses.

2. Prior Art

Flush-type door locks including a housing, a slidable lock bolt, and an operating handle for moving the bolt relative to the housing are well known. Usually the handle is in a flush or nested position when the bolt is projected and pivots to an operating position to effect bolt retraction. Locks of this type are well suited for use on swinging doors of vehicles such as trucks, on merchandise, tool and equipment cabinets, and the like.

Flush-type paddle-handle door locks employing a key-turned, rotatable cam for selectively permitting and preventing unlocking movement of a handle, and having a spring projected sliding bolt, are described in U.S. Pat. Nos. 3,707,862 and 3,668,907 granted Jan. 2, 1973 and June 13, 1972, respectively, to John V. Pastva, Jr. Both of these patents disclose the use of a pushrod between a bolt-actuator and a rotatable locking member. An ornamental appearance employed in locks of this general type is illustrated in design U.S. Pat. No. 230,132 issued Jan. 29, 1974 to John V. Pastva, Jr.

In applicant's U.S. Pat. No. 3,209,564, issued Oct. 5, 1965, a flush-type lock construction is described wherein a one-trip unlatching movement of a handle is permitted after a key has been turned once in a lock cylinder. In the described lock construction, a relatively complex mechanism including a separate, spring-biased, detent-controlled slide pin is employed to provide the one-trip unlatching action. Such a mechanism is not retrofitable on in-service flush-type door locks.

Prior to the conception of the present invention, applicant devised a flush-type door lock having a locking member rotatable by a key between positions for permitting or preventing unlocking operation of a handle. The lock included a single relatively stiff torsion spring which performed dual service in biasing two separate detent components of an automatic latching linkage. The linkage was intended to perform the functions of releasably retaining the locking member in an unlocked position following actuation by a key control, and of returning the locking member to its locked position following a single operation of the handle. The construction and arrangement of components utilized in this lock proposal was found to provide an unpractical device which was not reliable in its operation and which was difficult to assemble. Assembly of the components required that opposite ends of a relatively stiff, dual-function torsion coil spring be fitted into engagement with two separate detent components, both of which were movable relative to the lock body. Attempts to retrofit the proposed automatic locking linkage on existing in-service locks were found to be very difficult to carry out in the limited access space provided by many existing lock installations. A significant drawback of locks embodying the previously proposed construction was that opposite ends of the stiff, relatively heavily loaded, dual-purpose torsion spring tended to disengage themselves from one or both of the detent components. When the spring ends became disengaged, not only did the automatic locking feature cease to function, but also, in many instances, the lock was prevented from being locked even through manual efforts. While a few locks embodying this unsatisfactory proposal were sold more than one year prior to the filing of the present application, the majority of locks made embodying this proposal have been recalled and/or scrapped because the proposal embodied in such locks did not provide a commercially acceptable product.

SUMMARY OF THE INVENTION

The present invention overcomes the foregoing and other drawbacks of the prior art by providing a novel and improved, reliable and durable flush-type door lock which is relatively maintenance free and which has automatic one-trip latching linkage components that may be retrofitted relatively easily on existing, in-service flush-type door locks.

A door lock embodying principles of the invention preferably includes a support structure or body having side and back walls which cooperate to define a forwardly facing recess. A bolt is slidably supported on the body at a location behind the back wall. The bolt is movable between projected and retracted positions with respect to the body, and a compression coil spring biases the bolt toward its projected position. A handle is supported on the body for swinging movement between a nested position and an operating position.

The door lock further includes a locking mechanism having a locking member which is movable between a locked position wherein it operates to prevent movement of the handle to its operating position, and an unlocked position wherein it does not operate to prevent movement of the handle to its operating position.

The door lock additionally includes an automatic latching linkage for retaining the locking member in its unlocked position once it has been moved thereto through operation of the locking mechanism, whereby the handle is permitted to move to its operating position; and for returning the locking member to and retaining it in its locked position once the handle has been moved one time to its operating position and returned to its nested position. Stated in another way, the automatic locking linkage provides the door lock with a capability to be opened once following the "cocking" of a latching mechanism, and which cannot be opened again until the latching mechanism is again "cocked" by turning a key in a lock cylinder.

The automatic latching linkage includes several improvements over previously proposed linkage systems. It employs two detent members pivoted about separate first and second axes, and two torsion coil springs, each of which is coiled about a separate one of the first and second axes and biases a separate one of the detent members. The springs operate entirely independently of each other and therefore do not need to be excessively tightly wound, as was the case in previous proposals where a single stiff spring was called upon to perform dual functions. An important feature of the components of the automatic latching linkage is that they can be assembled easily, essentially one at a time, in a stacked arrangement, utilizing the fingers of a single hand. The springs are installable one at a time during assembly, and the ends of each spring are positionable one at a time in engagement with their associated operating components. The ease with which the latching linkage components can be assembled permits these components to be retrofitted on existing in-service locks where accessibility is quite restricted.

A feature of door locks which embody the preferred practice of the invention is that their components can be simply formed without requiring much in the way of precision machining. While the detent members of the automatic latching system are of relatively complex configuration, these parts can be formed accurately and inexpensively from plastics material utilizing injection molding techniques. The springs employed in the lock are arranged such that none of the relatively movable parts of the lock are free to rattle when the lock is subjected to vibration. Moreover, the torsion coil springs employed in the automatic latching mechanism are not so tightly wound or heavily loaded as to cause them to disengage their associated operational components when the lock is subjected to vibration.

As will be apparent from the foregoing summary, it is a general object of the present invention to provide a novel and improved, flush mountable, key-controlled door lock, which may be unlocked once a key-operated latching linkage is cocked, but which returns, after a single unlatching operation of the handle, to a locked condition wherein the handle cannot be operated until the key is again turned, regardless of whether the key is in or out of the lock.

These and other objects and a fuller understanding of the invention described in the present application may be had by referring to the following detailed description and claims taken in conjunction with the accompanying drawings.

DESCRIPTION OF THE PREFERRED EMBODIMENT

Figure 1:
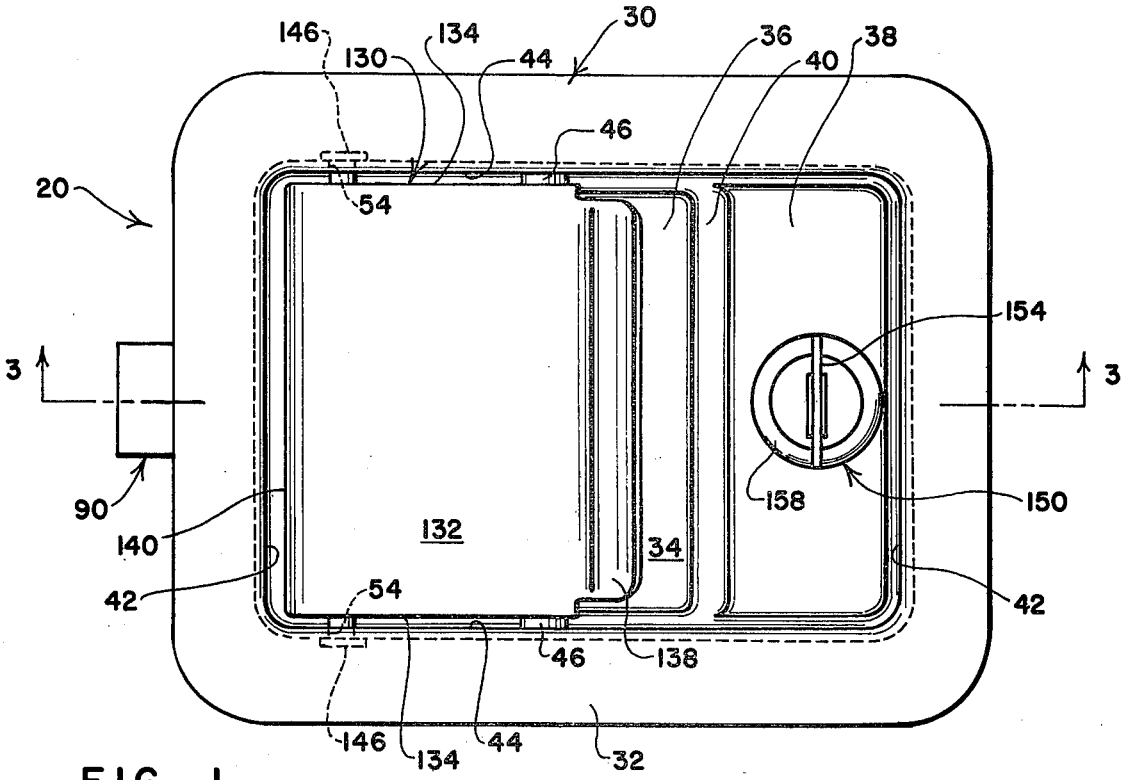
FIG. 1 is a front side elevational view of a door lock embodying the present invention.

Referring to FIGS. 1–4, a key-controlled, flush-type lock embodying the preferred practice of the present invention is indicated generally by the numeral 20. The lock 20 is adapted to be supported on such structures as a swinging door (not shown) for relative movement therewith to bring the lock 20 into and out of juxtaposition with a suitable conventional striker plate (not shown) supported on a door frame or other structure (not shown). The manner in which locks of this general type are mounted on doors is well known to those skilled in the art. The mounting of such locks is described and illustrated in such patents as Pastva, Jr. U.S. Pat. No. 3,668,907.

In general, the lock 20 includes a recessed body 30 having a bolt housing 60 welded to the rear side of the body 30. A bolt 90 is slidably carried in the bolt housing 60 for movement between retracted and projected positions. A compression coil spring 110 biases the bolt 90 toward its projected position. A paddle handle 130 is pivotally carried on the body for movement between nested and operating positions. A key control 150 including a pushrod 180 is provided for selectively permitting and preventing movement of the handle 130 out of its nested position. A one-trip automatic latching linkage, indicated generally by the numeral 250, is provided to assure that the handle 130 may move once, but only once, out of its nested position once the automatic latching linkage 250 has been "cocked"by operating the key control 150. A housing assembly 200, including a base 202 and a cover 204, protectively encloses components of the key control 150 and the linkage 250. The construction and operation of these elements will be described in greater detail in the discussion which follows.

Referring to FIGS. 1–4, the body 30 is a rectangular, pan-shaped sheet metal stamping having a perimetrically extending flange 32 which surrounds a forwardly facing recess 34. Left and right back wall portions 36, 38 define different depth levels in opposite end portions of the recess 34. An inclined back wall portion 40 interconnects the left and right back wall portions 36, 38. Forwardly extending end walls 42 and side walls 44 connect the back wall portions 36, 38, 40 with the flange 32.

Other features of the body 30 include a pair of stops 46 formed in the left back wall portion 36. The stops 46 project into the recess 34 at locations along the side walls 44 and are engaged by the handle 130 when the handle 130 is in its nested position. An elongate slot 48 is provided in the left back wall portion 36 at a location overlying the bolt 90. A hole 50 is formed through the right back wall portion 38. Opposite sides of the hole 50 have flat, parallel-extending surfaces 52. Aligned holes 54 are formed through the side walls 44 near their left ends.

The bolt housing 60 is a channel-shaped sheet metal stamping having a bottom wall 62, a pair of opposed side walls 64, and a pair of mounting flanges 68. The flanges 68 overlie and are welded to the rear side of the left back wall portion 36.

The bolt housing 60 cooperates with the left back wall portion 36 to define an elongate passage 70 within which the bolt 90 is guided for sliding movement. The bottom wall 62 has an integrally formed tab 72 which is folded over to close a majority of the area of the right end of the bolt passage 70. The side walls 64 have a pair of integrally formed locking tabs 74 which are folded to overlie the tab 72 to reinforce the bottom wall tab 72. As is best seen in FIG. 3, the bottom wall tab 72 stops short of the rearward surface of the left back wall portion 36, permitting the pushrod 180 to be slidably carried therebetween.

The bolt 90 is a solid metal member which can be formed by conventional casting or powder metallurgy techniques. The bolt 90 has a generally rectangular cross section which corresponds to that of the passage 70. The bolt 90 has a taperd left end 92 configured, as is conventional, to permit the bolt to be retracted in response to engagement with a suitable striker plate (not shown) during door closing. The bolt 90 has a flat right end 94. An elongated slot 96 is formed through central portions of the bolt 90. The slot 96 has left and right end walls 100, 102 at its opposite ends.

Figure 2:
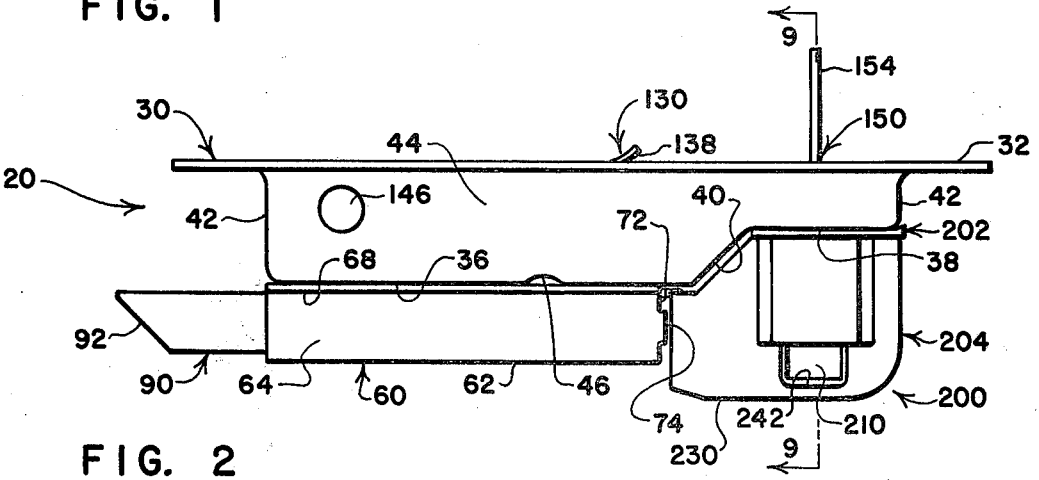
FIG. 2 is a bottom plan view of the door lock of FIG. 1.
Figure 3:
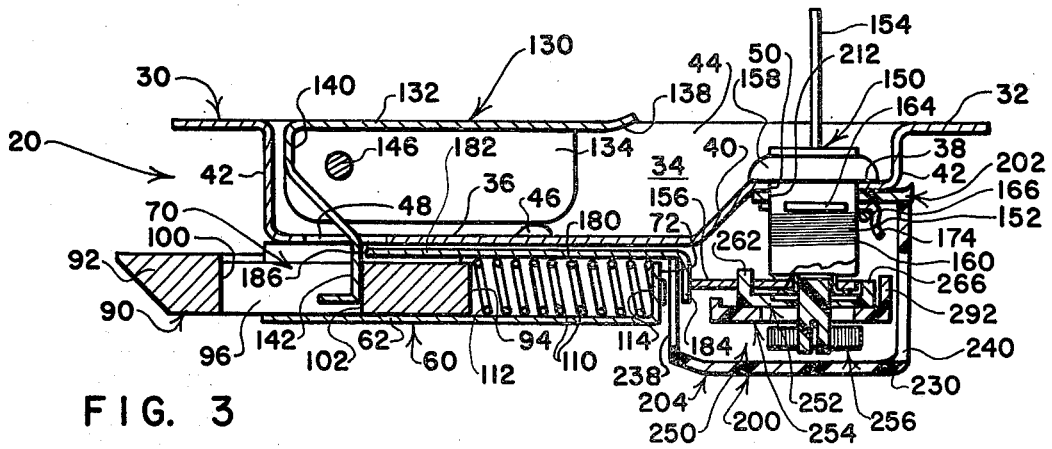
FIG. 3 is a sectional view as seen from a plane indicated by a line 3—3 in FIG. 1.
Figure 8:
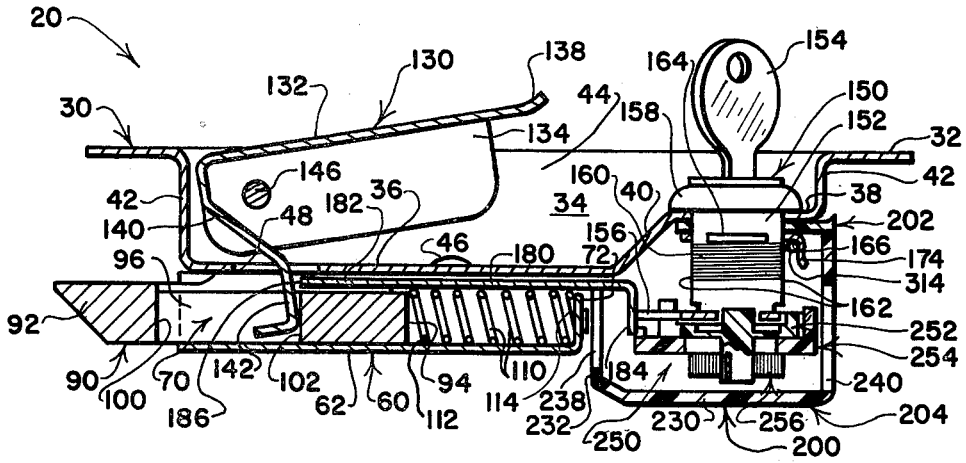
FIG. 8 is a sectional view corresponding generally to FIG. 3 but showing the handle during movement toward its operating position and with other components being moved in response to movement of the handle.

The bolt 90 is movable between a projected position, shown in FIGS. 1–3, and a retracted position wherein the left tapered end 92 of the bolt 90 extends substantially evenly with the left edge of the body flange 32. Partial retraction of the bolt 90 is illustrated in FIG. 8.

The compression coil spring 110 is positioned in the passage 70. The spring 110 has a left end 112 which engages the bolt end 94, and a right end 114 which engages the bottom wall tab 72. The spring 110 biases the bolt 90 leftwardly toward its projected position, and is compressed to progressively greater degrees as the bolt 90 is retracted.

The paddle handle 130 is a sheet metal stamping having a generally rectangular, substantially flat plate portion 132 and a pair of opposed, in-turned side flanges 134. An outwardly turned gripping flange 138 is provided at the right end of the handle 130, and an inturned operating flange 140 is provided at the left end. An operating arm 142 is formed as an integral projection of the operating flange 140.

The handle 130 has aligned mounting holes 144 formed through its side flanges 134. A headed pin 146 extends through the body holes 54 and through the handle holes 144 to pivotally mount the handle 130 on the body 30 at a location between the body side walls 44.

The handle's operating arm 142 extends through the back wall slot 48 and into the bolt slot 96. When the handle 130 is in its normal nested position, as shown in FIGS. 1–3, the spring 110 biases the bolt slot end surface 102 into engagement with the operating arm 142, and, in turn, biases the handle 130 clockwise, as viewed in FIGS. 2 and 3, to maintain the handle side flanges 134 in engagement with the bottom wall stops 46. When the handle 130 is pivoted counterclockwise about the axis of the pin 146, as viewed in FIG. 8, the engagement between the operating arm 142 and the slot end surface 102 causes the bolt 90 to be retracted rightwardly in the passage 70 in opposition to the action of the spring 110.

As is seen in FIG. 3, the operating arm 142 normally engages only the slot end surface 102 and is normally spaced from the opposite slot end surface 100. The spacing between the slot end surfaces 100, 102 permits the bolt 90 to be retracted, i.e. moved rightwardly in the passage 70, without requiring corresponding pivotal movement of the handle 130. This capability is desirable to permit the lock 20 to be "slammed" into a locked configuration with the bolt 90 engaging a suitable striker plate (not shown), without requiring that the paddle handle 130 pivot out of its nested position where it may be locked by the key control 150.

Figure 5:
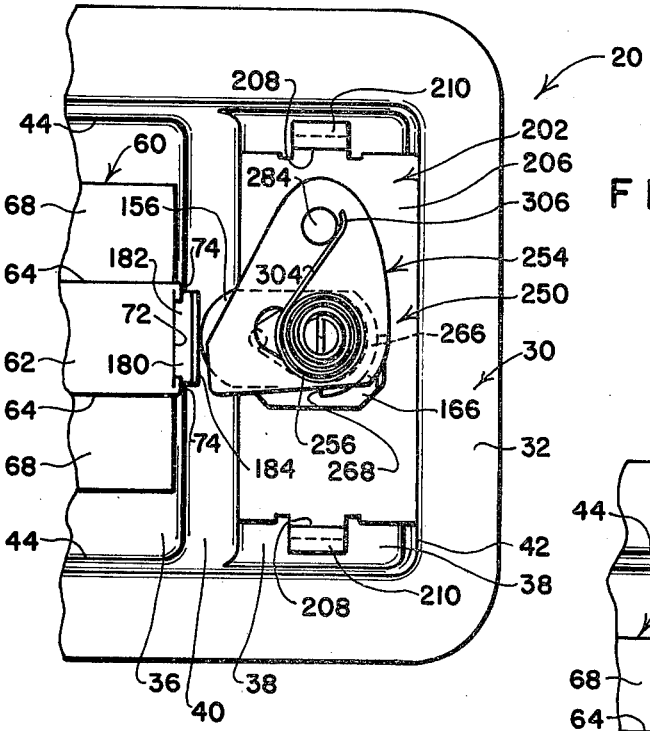
FIGS. 5, 6 and 7 are rear elevational views of a portion of the door lock of FIG. 1 with a cover removed to permit the positions of relatively movable components to be seen.
Figure 6:
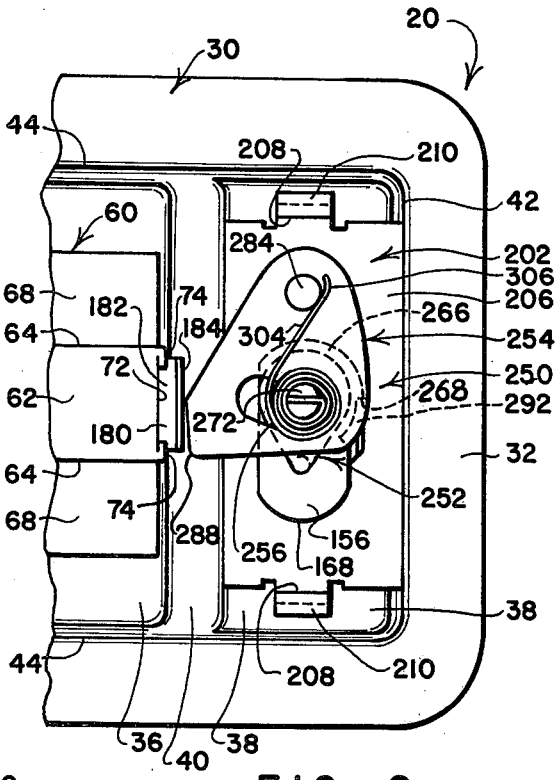

The key control 150 includes a lock cylinder 152 into which a key 154 may be inserted. The key 154 is configured to cooperate with tumblers housed within the cylinder 152 to permit a locking member 156 to be rotated relative to the cylinder 152 between locked and unlocked positions. The locked position of the locking member 156 is shown in FIGS. 3 and 5. The unlocked position of the locking member 156 is shown in FIG. 6.

The cylinder 152 is provided with an enlarged head 158 and a threaded body 160. A pair of flats 162 are formed on opposite sides of the threaded body 160. A pair of slots 164 are formed in opposite sides of the threaded body 160. The cylinder 152 is positioned with its head 158 engaging the forward surface of the right body portion 38, with its body 160 extending through the hole 50, and with its flats 162 engaging the flat surfaces 52. As will be explained in greater detail, the cylinder body 160 also extends through a hole 212 formed in the housing base 202. A conventional resilient locking clip 166 has opposed arms which are received in the cylinder side slots 164 to hold the cylinder 152 and the housing base 202 in place on the lock body 30.

Other features of the key control 150 include a rounded end formation 168 provided on the locking member 156, a hole 170 formed through the locking member 156, and a cylindrical depression 172 formed where the locking member 156 meets the axis of the cylinder 152. The locking clip 166 has an in-turned flage 174 which extends in spaced relationship alongside one of the flats 162. The purposes served by these features will be explained as the description continues.

While the key control 150 is of a conventional, commercially available type, it is selected from among various commercially available key controls to have particular operational characteristics. These operational characteristics should include key removal capability when the locking member 156 is positioned in either of its locked and unlocked positions. A further characteristic is that once the locking member 156 has been positioned in its locked position and the key 154 has been removed from the cylinder 152, the key control 150 should maintain the locking member 156 in its locked position. Finally, the key control 150 should include an operating characteristic which assures that the locking member 156 can only be restrained against moving relative to the cylinder body 160 when the locking member is in its locked position. These operational characteristics assure that when the locking member 156 is in any position other than its locked position, regardless of whether the key 154 is inserted in the cylinder 152, the locking member 156 may be turned relative to the cylinder 152. However, once the free-turning locking member 156 has been returned to its locked position, it is retained therein and can only be released therefrom by turning the key 154 in the cylinder 152. A key control 150 of this type is commercially available from a number of sources. It can be purchased, for example, from Illinois Lock Company under the model designation No. 4910-51.

The pushrod 180 provides a means of operably interconnecting the handle operating arm 142 and the locking member 156. The pushrod 180 is an L-shaped metal stamping having a relatively long leg 182 and a relatively short leg 184. The long leg 182 extends through the bolt housing passage 70 and has a flat end 186 configured to engage the handle operating arm 142. The short leg 184 provides an abutment surface engageable by the rounded end 168 of the locking member 156 when the locking member 156 is in its locked position.

When the locking member 156 is locked, as shown in FIG. 3, any attempt to pivot the handle 130 out of its nested position will cause the operating arm 142 to engage the pushrod end 186, whereupon the pushrod 180 will be moved rightwardly, bringing its short leg 184 into abutting engagement with the locking member 156. By this arrangement, the locking member 156 normally prevents the handle 130 from moving out of its nested position. When the locking member 156 has been rotated to its unlocked position, as shown in FIG. 6, it no longer blocks rightward sliding movement of the pushrod 180, whereby the handle 130 may be pivoted out of its nested position to effect retraction of the bolt 90. The rounded end 168 of the locking member 156 facilitates efforts to pivot the locking member 156 to its locked position by causing the pushrod end 184 to be engaged and pushed toward the passage 70 to a position out of the path of travel of the locking member 156.

Figures 4, 10, 11:
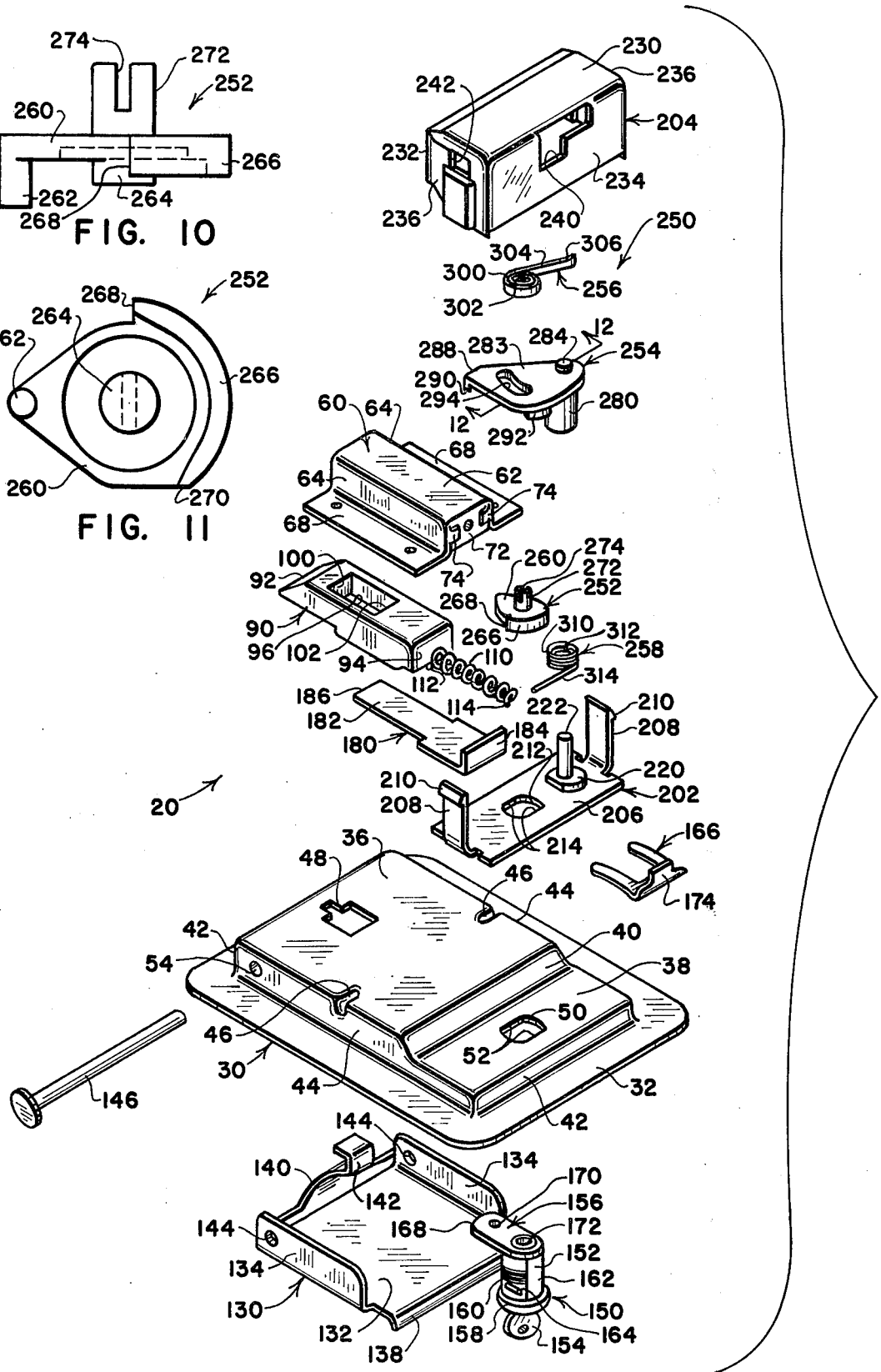
FIG. 4 is an exploded perspective view of the door lock.
FIG. 10 is an enlarged plan view of a first detent member employed in the door lock.
FIG. 11 is an elevational view of the first detent member.

Referring to FIG. 4, the base 202 and cover 204 of the housing assembly 200 are preferably formed from plastic such as high impact polystyrene. The base 202 has a flat, substantially rectangular base portion 206, and a pair of opposed, upstanding arms 208. Barb-like latching formations 210 are provided on the arms 208. The hole 212 is formed in the base portion 206 at a central location between the arms 208. The hole 212 has flat surfaces 214 in its opposite sides. The flat surfaces 214 engage the cylinder body flats 162 to prevent the base 202 from turning relative to the body 30.

The base 202 has an integrally formed raised shoulder formation 220 located at one side of the hole 212. A cylindrical stem 222 is formed integrally with the shoulder formation 220 and projects away therefrom along an axis which parallels the axis of the lock cylinder 152.

Figure 9:
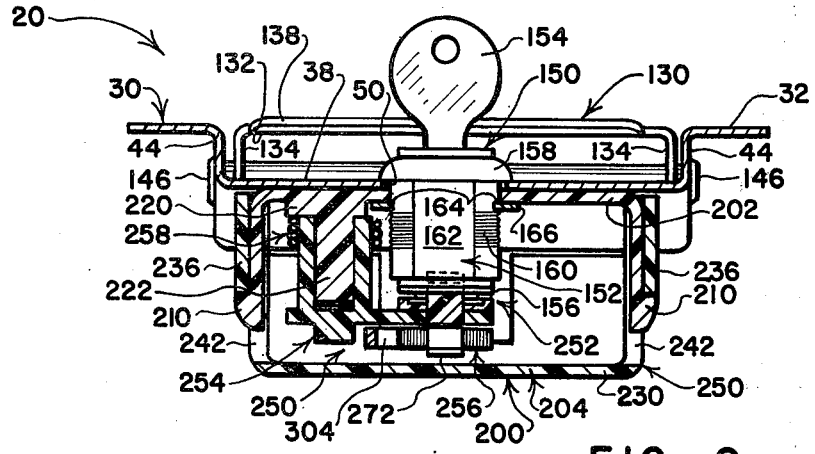
FIG. 9 is a sectional view as seen from a plane indicated by a line 9—9 in FIG. 2.

Referring still to FIG. 4, the cover 204 has a back wall 230 of generally rectangular shape. End walls 232, 234 and side walls 236 are formed integrally with the top wall 230. A rectangular slot 238 is formed in the end wall 232, as best seen in FIGS. 3 and 8, to permit interengagement between the pushrod 180 and components housed within the housing assembly 200. An L-shaped slot 240 is formed in the end wall 234, as best seen in FIG. 4, to provide operating clearance for detent components of the automatic latching linkage 250. Rectangular openings 242 are formed in the side walls 236, as best seen in FIGS. 4 and 9. The barb-like latching formations 210 are receivable in the side wall openings 242 to releasably retain the cover 204 in place on the base 202.

The cover 204 is installed by depressing the base arms 208 sufficiently inwardly toward each other to permit the latching formations 210 to slide along the inner surfaces of the side walls 236. The cover 204 may be removed by depressing the barb-like latching formations 210 inwardly to permit their passing along the inner surfaces of the cover side walls 236. The arms 208 are resilient and normally bias the latching formations 210 in directions away from each other to hold them securely in place within the cover openings 242.

The one-trip automatic latching linkage 250 employs relatively complexly configured components but is quite simple in concept. It serves the function of assuring that the handle 130 may be moved once, but only once, out of its nested position after the key control 150 has moved the latching member 156 to its unlatched position. The linkage 250 functions by:

(1) Retaining the latching member 156 in an unlatched position, once it has been moved to an unlatched position, until the handle 130 has been moved out of its nested position; and, (2) Returning the latching member 156 to its latched position as the handle 130 returns to its nested position once the handle 130 has been moved out of its nested position.

Referring to FIG. 4, in order to perform these functions, the linkage 250 is provided with first and second interacting detent members 252, 254, and first and second torsion coil springs 256, 258. The first detent member 252 is carried on the locking member 156 and is movable therewith. The second detent member 254 is journaled on the housing base stem 222 and is pivoted about the axis of the stem 222. The first torsion coil spring 256 operates to bias the first detent member 252 clockwise, as viewed in FIGS. 5–7. Due to the interconnection of the first detent member 252 and the latching member 156, the first torsion coil spring 256 is effective to bias the latching member 156 toward its locked position. The second torsion coil spring 258 operates to bias the second detent member 254 clockwise, as viewed in FIGS. 5–7. As will be explained, it is this biasing action which causes the detent members 252, 254 to interengage in such a manner as will releasably retain the latching member 156 in its unlocked position.

Referring to FIGS. 4, 10 and 11, the first detent member 252 is formed from injection-molded plastics material and has a substantially oval-shaped body 260 configured to overlie the locking member 156. As is best seen in FIG. 10, first and second cylindrical, integrally formed projections 262, 264 are provided on one side of the body 260. The first projection 262 extends into the locking member hole 170, and the second projection 264 extends into the depression 172. An arcuate flange 266, best seen in FIG. 11, is provided near the periphery of the body 260, and depends alongside the locking member 156. The flange 266 has opposite ends 268, 270. The projections 262, 264 and the flange 266 cooperate to establish a play-free driving connection between the first detent member 252 and the locking member 156. The end 268 provides what will be referred to as a first detent formation. An integrally formed cylindrical projection 272 is provided on the opposite side of the body 260 from the projections 262, 264. A radially extending slot 274 is formed in the projection 272.

Figure 12:
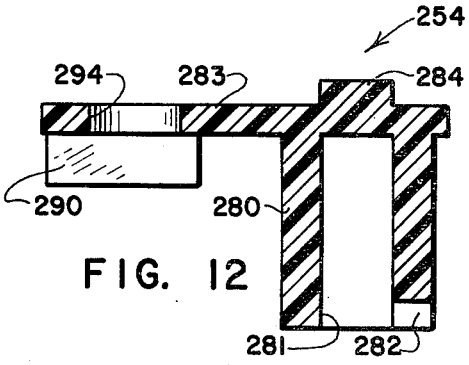
FIG. 12 is an enlarged sectional view of a second detent member as seen from a plane indicated by a line 12—12 in FIG. 4.
Figure 13:
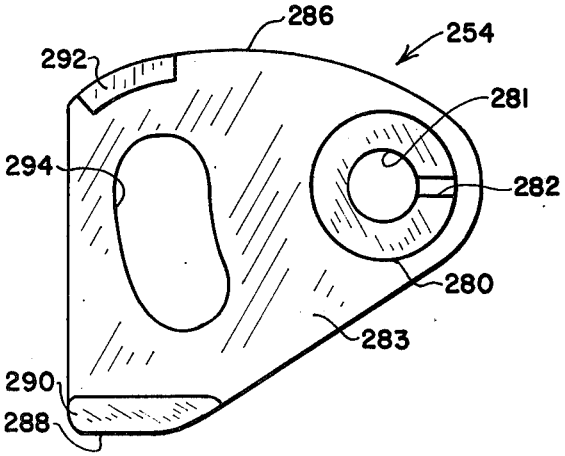
FIG. 13 is an elevational view of the second detent member.

Referring to FIGS. 4, 12 and 13, the second detent member 254 is formed from injection-molded plastics material and has a cylindrical tubular stem 280 with a bore 281 configured to be journaled on the base stem 222. A slot 282 is formed in one side of the stem 280. A substantially flat cam portion 283 is formed integrally with the stem 280 and extends in a plane which is perpendicular to the axis of the stem 280. A raised cylindrical projection 284 is formed integrally with the cam portion 283 and has an axis coincident with the axis of the stem 280. The cam portion 283 has a periphery 286 of irregular shape including a flat abutment surface 288 reinforced by a depending lug 290. A detent formation 292 depends from the periphery 286 at a location spaced from the abutment surface 288. A curved elongate slot 294 is formed through the cam portion 283 at a location intermediate the locations of the surface 288 and the second detent formation 292. As will be explained, the stem 272 of the first detent member 252 projects through the slot 294, and opposite ends of the slot are engageable with the stem 272 to limit the range of rotation of the second detent member 254.

The first torsion coil spring 256 has a coil 300 wrapped about a first end 302, and has an arm 304 which extends tangentially from the coil 300. The arm 304 terminates in a curved end formation 306. The second torsion coil spring 258 has a helically wound coil 310 with a first end 312 extending radially into the coil 310, and an elongate second end 314 extending tangentially away from the coil 310.

A feature of the components of the automatic latching linkage 250 is that they can be installed simply and easily in an essentially one-at-a-time fashion utilizing the fingers of one hand. With the housing base 202 already locked in place by the resilient locking clip 166, installation of the latching linkage components is begun by positioning the first detent member 252 on the locking member 156 with the cylindrical projections 262, 264 extending into the hole and depression 170, 172, respectively. The second torsion coil spring 258 is then positioned on the cylindrical stem 280 of the second detent member 254 with the spring coils 310 reeved around the stem 280 and with the first spring end 312 extending radially into the slot 282. With the second spring 258 in position on the stem 280 of the second detent member 254, the stem 280 is positioned over the cylindrical base member stem 222. As the stem 222 is inserted into the bore 281, the second spring end 314 is introduced between the locking clip flange 174 and the nearby flat 162 of the cylinder 152. The locking clip flange 174 serves to retain the spring end 314 from rotating relative to the body 30.

As the second detent member 254 assumes its operating position, the cylindrical projection 272 on the first detent member is extended through the elongate slot 294 formed in the second detent member 254. Once the second detent member 254 is in its operating position, the first torsion coil spring 256 is positioned with its coil 300 reeved around the cylindrical projection 272 and with its inner end 302 extending radially into the slot 274. The arm 304 is then turned clockwise, as viewed in FIGS. 5–7, to position the curved end formation 306 in engagement with the raised cylindrical projection 284 formed on the second detent member 254.

With the components of the automatic latching linkage 250 in position, as described, the housing cover 204 is snapped into position to retain the latching linkage components in their operating positions.

As will be appreciated, the relatively simple steps required to assemble the automatic latching linkage components permits these components to be installed on existing, in-service locks where access to the rear faces of the locks is quite limited. Since the fingers of only one hand are required to manipulate the latching linkage components into their final, assembled position, very little in the way of access space is required to affect their assembly. A trained operator can, in fact, assemble these components entirely by touch alone thereby obviating the need for a line of sight view of the assembly area.

The assembled components of the latching linkage 250 assume a substantially layered-like array. The first and second detent members 252, 254 have portions which overlie each other in separate planes spaced rearwardly from the body structure 30, and the torsion coil springs 256, 258, likewise, have portions which overlie each other in separately spaced planes.

In operation, when it is desired to retract the bolt 90 of the lock 20, the key 154 is turned in the lock cylinder 152. As the key 154 turns, the second detent formation 292 rides along the arcuate depending shoulder 266 of the first detent member 254. When the key 154 is turned to a position where the second detent formation 292 can move along side the first detent formation 268 under the influence of the second torsion coil spring 258, the second detent formation 292 snaps into position along side the first detent formation 268, as illustrated in FIG. 6. The first and second detent formations 268, 292 are then interengaged and operate to retain the locking member 156 in its unlocked position. The key 154 can then be removed from the lock cylinder 152 or can remain therein, as the operator may choose.

Figure 7:
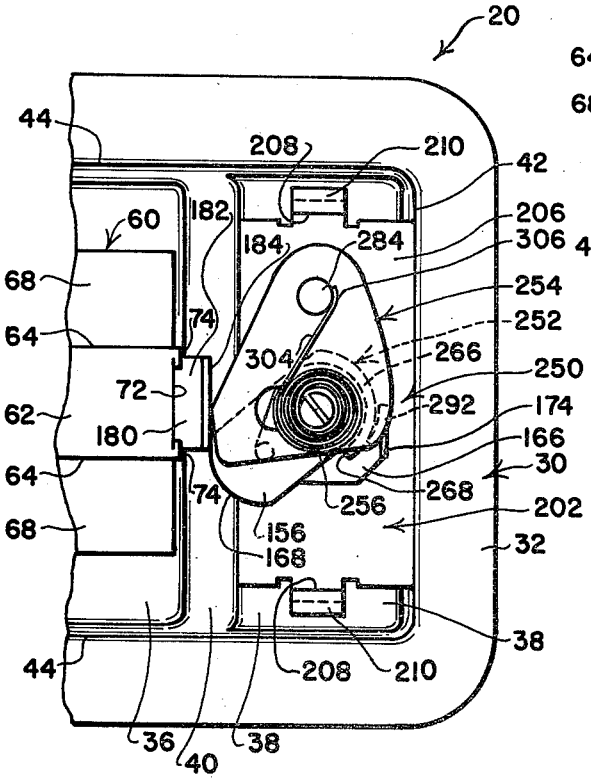

When the handle 130 is pivoted out of its nested position to its operating position, the pushrod 180 is caused to move out of the bolt passage 70 and its abutting surface 184 is caused to engage the striker surface 288 of the second detent member 254, causing the second detent member 254 to pivot counterclockwise about the axis of the stem member 222, as viewed in FIG. 7. As the second cam member 254 pivots in this manner, the second detent formation 292 is moved away from the first detent formation 268, terminating the engagement between the first and second detent formations 268, 292. When this interengagement is terminated, the first detent member 254 and the locking member 156 are freed for rotation under the influence of the first torsion coil spring 256 to move toward their locked position. As the handle 130 returns to its nested position, permitting the pushrod 180 to withdraw inwardly of the bolt passage 70, the locking member 156 reassumes its locked position. Once the locking member 156 is in its locked position, it is retained there under the influence of the first torsion coil spring 256 and the operation of the key lock 150. If the handle 130 is to be moved out of its nested position again, it cannot be so moved until the key 154 is turned, once again, in the locked cylinder 152. Accordingly, the latching linkage 250 permits only a single operational of the handle 130 following a cocking operation performed by turning the key 154 in the lock cylinder 152.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A self-locking door lock actuable for one-trip unlatching, comprising:

(a) a support structure including guide means;

(b) a bolt guided by the guide means for movement between latching and unlatching positions;

(c) a handle connected with the support structure for swinging movement between a normal position and an operating position, and being cooperable with the bolt for moving the bolt toward its unlatching position in response to swinging movement of the handle toward its operating position;

(d) biasing means urging the bolt toward its latching position;

(e) a locking mechanism including a locking member movable between a locked position wherein it prevents movement of the handle to its operating position, and an unlocked position wherein it permits movement of the handle to its operating position; and, (f) automatic latching means for retaining the locking member in its unlocked position once it has been moved thereto through operation of the locking mechanism, and for returning the locking member to and retaining it within its locked position once the handle has been moved one time to its operating position, the automatic latching means including:

(i) first and second detent members being provided, respectively, with first and second interengageable detent formation means, the first detent member being operably connected to the locking member for movement therewith between its locked and unlocked positions, and the second detent member being movably connected to the support structure for movement between retaining and non-retaining positions;

(ii) first and second biasing means, the first biasing means being operable to bias the first detent member and the locking member toward the locked position, and the second biasing means being operable to bias the second detent member toward its retaining position;

(iii) the detent formation means being operable to interengage each other when (a) the first detent member is pivoted with the locking member to the unlocked position and (b) the second detent member is moved to its retaining position under the influence of the second biasing means;

(iv) the detent formation means being operable when interengaged to retain the first detent member and the locking member in the unlocked position; and, (v) connecting means operably interconnecting the second detent member and the handle for moving the second detent member to its non-retaining position as the handle moves to its operating position, whereby the detent formation means are moved out of interengagement and the first detent member and the locking member are accordingly freed to return to the locked position under the influence of the first biasing means;

(vi) the first and second biasing means comprising separate springs installable one at a time during assembly of the locking means and operating independently of each other to perform their separate functions.

2. The door lock of claim 1 wherein:

(a) the locking mechanism includes structure mounting the locking member and the first detent member for pivotal movement about a first axis;

(b) the automatic latching means includes structure mounting the second detent member for pivotal movement about a second axis which substantially parallels the first axis and is spaced therefrom;

(c) the first biasing means comprises a first torsion coil spring having a spring coil wound substantially about the first axis; and, (d) the second biasing means comprises a second torsion coil spring having a spring coil wound substantially about the second axis.

3. The door lock of claim 2 wherein:

(a) the first detent member has a spring-receiving formation thereon;

(b) the second detent member has a projection extending along the second axis; and, (c) the first torsion coil spring has one end received in the spring-receiving formation and its other end extending into engagement with the projection.

4. The door lock of claim 3 wherein:

(a) the first detent member has an elongate formation extending along the first axis in a direction away from the locking member, and the spring-receiving formation is provided on the elongate formation; and, (b) the second detent member has a cam formation with one side facing toward the locking member and the other side facing away therefrom, the cam formation overlying the first axis and having an elongate slot formed therein, through which slot the elongate formation of the first detent member projects.

5. The door lock of claim 3 wherein the first and second detent members, and the first and second torsion coil springs are configured to permit their sequential installation during assembly of the door lock with the first detent member being positionable on the locking member as a first assembly step, the second detent member and the second torsion coil spring being positionable for pivotal movement about the second axis as a second assembly step, and the first torsion coil spring being positionable in engagement with the receiving formation and with the projection as a third assembly step.

6. The door lock of claim 2 wherein:

(a) the second detent member has a slot formed therein;

(b) the support structure includes means for retaining the locking mechanism thereon; and, (c) the second torsion coil spring has one end extending into the slot and its other end extending into engagement with the retaining means.

7. The door lock of claim 1 wherein the first and second biasing means comprise first and second torsion coil springs, the first torsion coil spring being coiled about a first axis and having a first end portion extending in a plane substantially perpendicular to the first axis, the second torsion coil spring being coiled about a second axis which extends substantially parallel to the first axis, the second torsion coil spring having a second end portion extending in a plane substantially perpendicular to the second axis, the first and second torsion coil springs being spaced in axial directions from each other and being installable one at a time during assembly of the automatic locking means, and the first and second end portions substantially overlying each other once the automatic locking means has been assembled.

8. The door lock of claim 1 wherein the first and second detent members respectively carry first and second cylindrical formations extending along parallel, spaced, first and second axes, the first biasing means comprises a first torsion coil spring having one end connected to the first cylindrical formation and having coils reeved therearound, and the second biasing means comprises a second torsion coil spring having one end connected to the second cylindrical formation and having coils reeved therearound.

9. A self-locking, key-controlled door lock actuable for one-trip unlatching, comprising:

(a) a support structure including guide means;

(b) a bolt guided by the guide means and movable between latching and unlatching positions;

(c) resilient means urging the bolt toward its latching position;

(d) a handle connected with the support structure for swinging movement between a normal position and an operating position, and being cooperable with the bolt for moving the bolt toward its unlatching position in response to swinging movement of the handle toward its operating position;

(e) a key-controlled locking mechanism including a locking member movable between a locked position wherein it operates to prevent movement of the handle out of its normal position, and an unlocked position wherein it permits movement of the handle out of its normal position;

(f) one-trip automatic latching means for:

(i) biasing the locking member toward its locked position to normally maintain the locking member in its locked position;

(ii) retaining position once it has been positioned therein by the key-controlled locking mechanism, until the handle is moved to its operating position; and, (iii) returning the locking member to its locked position after it has been retained in its unlocked position and after the handle has been moved one time to its operating position;

(g) the automatic latching means including:

(i) first detent means defining a first detent formation movable with the locking member;

(ii) second detent means defining a second detent formation movable relative to the support structure and being interengageable with the first detent formation when the locking member is moved to its unlocked position for releasably retaining the locking member in its unlocked position;

(iii) first spring means for biasing the locking member toward its locked position;

(iv) second spring means for biasing the second detent means to bring the detent formations automatically into retaining interengagement when the locking member is moved to its unlocked position to effect retention of the locking member in its unlocked position; and, (v) actuating means for moving the second detent means, in response to movement of the handle to its operating position, to terminate retaining interengagement between the detent formations, whereby the locking member is permitted to return to its locked position under the influence of the first spring means as the handle returns to its normal position.

10. In a self-locking mechanism for a lock of the type having a bolt retractable by handle operation to an unlatching position, a handle movable with the bolt between latching and unlatching positions, and means for selectively permitting and preventing handle movement to retract the bolt, the improvement comprising:

(a) a movable actuating member having an abutment surface and being movable with operation of the handle and the bolt in an unlatching direction;

(b) a first operating means being movable between a locked position engaging the abutment surface of the actuating member to prevent its movement in the unlatching direction, and an unlocked position out of engagement with the abutment surface wherein the first operating means permits movement of the actuating member in the unlatching direction;

(c) first independent spring means urging the first operating means toward its locked position;

(d) a second operating means interengageable with the first operating means when the first operating means is in its unlocked position for releasably retaining the first operating means in its unlocked position;

(e) second independent spring means for urging the second operating means into interengagement with the first operating means when the first operating means is in its unlocked position; and, (f) the second operating means having a striker surface formed thereon for engagement by the abutment surface as the handle is moved to its operating position to move the second operating means sufficiently to release interengagement between the first and second operating means and to thereby free the first operating means to return to its locked position under the influence of the first spring means.

11. The lock of claim 10 wherein the first and second operating means are mounted for pivotal movement about spaced, parallel, first and second axes, respectively, and the first and second spring means comprise first and second torsion coil springs, the first torsion coil spring being coiled about the first axis, and the second torsion coil spring being coiled about the second axis.

12. The lock of claim 11 wherein the first operating means has a projection extending along the first axis, the second operating means has a cam formation which overhangs the first axis, an elongate slot is formed through the cam formation, the projection extends through the slot and is operable to engage opposite ends of the slot to limit the range of movement of the second operating means.

13. The lock of claim 12 wherein the first and second operating means carry first and second cylindrical formations extending along the first and second axes, respectively, the coils of the first torsion spring extend around the first cylindrical formation, and the coils of the second torsion spring extend around the second cylindrical formation.

14. A lock comprising:

(A) a unit comprising a slide bolt and an actuating handle operatively connected to each other for movement between latching and unlatching positions;

(b) a movable locking member movable between locked and unlocked positions for selectively, respectively preventing and permitting unlatching movement of the actuating handle, and key-controlled means for moving the locking member to its unlocked position;

(c) first operating means having a retaining position in which it has the capability of retaining the locking member in its unlocked position;

(d) second operating means movable between a detent engaging position wherein it functions to retain the first operating means in the unlocked position, and a detent disengaging position, and the second operating means being operably connected to the handle so as to be moved from the detent engaging position to the detent disengaging position with unlatching movement of the handle;

(e) first independent resilient means for biasing the first operating means toward its retaining position; and, (f) second independent resilient means for biasing the second operating means toward its detent engaging position.

15. The lock of claim 14 wherein:

(a) the first operating means is pivotally movable about a first axis;

(b) the second operating means is pivotally movable about a second axis which extends substantially parallel to the first axis;

(c) the first resilient means includes a first torsion coil spring having:

(i) an inner end connected to the first operating means at a location along the first axis;

(ii) coils extending about the first axis; and, (iii) an outer end extending away from the first axis in a direction substantially toward the second axis; and, (d) the second resilient means includes a second torsion coil spring having:

(i) an inner end connected to the second operating means at a location along the second axis;

(ii) coils extending about the second axis; and, (iii) an outer end extending away from the second axis in a direction substantially toward the first axis; and, (e) the outer ends lying in separate, axially spaced planes and substantially overlying each other.

16. The lock of claim 15 wherein such portions of the first and second operating means as are engageable with each other to releasably retain the locking member in its unlocked position are located between the axially spaced planes.

* * * * *